US007955669B2

(12) United States Patent
Nagase et al.

(10) Patent No.: US 7,955,669 B2
(45) Date of Patent: Jun. 7, 2011

(54) INK JET RECORDING MEDIUM AND INK JET RECORDING METHOD

(75) Inventors: Yoshiyuki Nagase, Kawasaki (JP); Teruaki Okuda, Tokyo (JP); Takeshi Hara, Kawasaki (JP); Takeshi Oota, Kawasaki (JP); Hirokazu Hyakuda, Wakayama (JP)

(73) Assignee: Canon Kabushiki Kaisha, Tokyo (JP)

( * ) Notice: Subject to any disclaimer, the term of this patent is extended or adjusted under 35 U.S.C. 154(b) by 456 days.

(21) Appl. No.: 12/252,670

(22) Filed: Oct. 16, 2008

(65) Prior Publication Data

US 2009/0110828 A1 Apr. 30, 2009

(30) Foreign Application Priority Data

Oct. 31, 2007 (JP) ..... 2007-283613
Sep. 30, 2008 (JP) ..... 2008-253341

(51) Int. Cl.
*B41M 5/40* (2006.01)

(52) U.S. Cl. ..... 428/32.31; 428/32.32; 428/32.34; 428/32.35; 428/32.37

(58) Field of Classification Search ..... 428/32.31, 428/32.32, 32.34, 32.35, 32.37
See application file for complete search history.

(56) References Cited

U.S. PATENT DOCUMENTS

| | | | | |
|---|---|---|---|---|
| 4,723,129 | A | 2/1988 | Endo et al. | 346/1.1 |
| 4,740,796 | A | 4/1988 | Endo et al. | 346/1.1 |
| 4,849,774 | A | 7/1989 | Endo et al. | 346/140 R |
| 5,122,814 | A | 6/1992 | Endo et al. | 346/33 R |
| 5,159,349 | A | 10/1992 | Endo et al. | 346/33 A |
| 5,521,621 | A | 5/1996 | Endo et al. | 347/15 |
| 5,754,194 | A | 5/1998 | Endo et al. | 347/15 |
| 6,383,611 | B1 | 5/2002 | Kohno et al. | 428/195 |
| 6,475,601 | B1 | 11/2002 | Sakaki et al. | 428/195 |
| 6,528,146 | B2 | 3/2003 | Okuda et al. | 428/195 |
| 2003/0054145 | A1* | 3/2003 | Tokunaga et al. | 428/195 |
| 2004/0185194 | A1* | 9/2004 | Kikuchi et al. | 428/32.32 |
| 2006/0194943 | A1 | 8/2006 | Hyakuda et al. | 528/354 |
| 2007/0231511 | A1 | 10/2007 | Okuda et al. | 428/32.34 |
| 2009/0011155 | A1 | 1/2009 | Kamo et al. | 428/32.25 |

FOREIGN PATENT DOCUMENTS

| | | |
|---|---|---|
| JP | 54-59936 | 5/1979 |
| JP | 61-58788 | 3/1986 |
| JP | 4-298378 | 10/1992 |
| JP | 5-246131 | 9/1993 |
| JP | 9-95044 | 4/1997 |
| JP | 10-324058 | 12/1998 |
| JP | 2002-46343 | 2/2002 |
| JP | 2003-276319 | 9/2003 |

* cited by examiner

*Primary Examiner* — Betelhem Shewareged
(74) *Attorney, Agent, or Firm* — Fitzpatrick, Cella, Harper & Scinto

(57) ABSTRACT

An ink jet recording medium comprising a substrate and an ink receiving layer which is provided on at least one surface of the substrate and contains inorganic fine particles having an average secondary particle size of 1-4 μm as measured by a Coulter counter method in an amount of 0.2-2.0 g/m$^2$ in terms of solid content mass. The ink receiving layer satisfies the following conditions with respect to a pore distribution curve as determined by a nitrogen adsorption method: (1) total pore volume in a pore size range of 10-30 nm is 0.25 ml/g or more, (2) total pore volume in a pore size range of 30-70 nm is 0.1 ml/g or more, and (3) volume ratio of the total pore volume in the pore size range of 10-30 nm to the total pore volume in the pore size range of 30-70 nm is from 1:0.4 to 1:1.

7 Claims, 1 Drawing Sheet

INK JET RECORDING MEDIUM AND INK JET RECORDING METHOD

BACKGROUND OF THE INVENTION

1. Field of the Invention

The present invention relates to an ink jet recording medium having a plain-paper-like feel, on the surface of which an ink receiving layer has been formed, and an ink jet recording method in which an image is formed on this ink jet recording medium with a water-based ink.

2. Related Background Art

Ink jet printers according to an ink jet recording system have been recently spread because a wide variety of printed images such as multi-color and high-quality photograph images, art images, poster images, office documents and CAD images are easily obtained at high speed from an ink jet printer.

Inks for this ink jet printer include water-based dye inks and water-based pigment inks. Accordingly, the printers include printers with which printing is performed with only water-based dye inks, printers with which printing is performed with only water-based pigment inks and printers with which printing is performed by using water-based dye inks and water-based pigment inks in combination.

Printing is very often conducted on plain paper, which is a medium of lowest prices, using such an ink jet printer, and so plain paper having high performance in spite of low price is required. However, plain paper, which can provide a printed article of sufficiently high performance, i.e., can achieve high coloring comparable with the so-called matte coated paper, even when printing is conducted with either a water-based dye ink or a water-based pigment ink, has not been yet realized under the circumstances.

The reason for this is considered to be as follows. The surface structure of ordinary plain paper is mainly formed of pulp fibers. When a water-based dye ink is used, an adsorption site of a dye is limited to the surfaces of the pulp fibers, and the adsorption site is small compared with matte coated paper, the surface of which is covered with inorganic fine particles. Therefore, the colorability is limited. On the other hand, when a water-based pigment ink is used, pigment particles fall in interstices between the pulp fibers, so that the amount of the water-based pigment ink fixable to the vicinity of the surface of the ink jet recording medium (plain paper) is limited, and so high coloring is not achieved.

In order to solve such problems, it has heretofore been attempted to improve fixability of water-based dye inks and water-based pigment inks. For example, an ink jet recording medium obtained by coating the surfaces of pulp fibers or the interiors of the pulp fibers with a cationic resin or polyvalent metal as an ink-fixing agent has been proposed (see Japanese Patent Application Laid-Open No. S61-058788). In this ink jet recording medium, the ink fixability is improved by an ionic action between the cationic resin or polyvalent metal ion and an anionic ink. In the case of the water-based dye ink, a large amount of the ink is fixed to pulp fibers existing in the vicinity of the surface of the ink jet recording medium. In the case of the water-based pigment ink, pigment particles are aggregated not only on the pulp fibers of the ink jet recording medium, but also in the interstices between the pulp fibers. It is said that the ink can be thereby fixed as near to the surface of the ink jet recording medium as possible. However, according to this method, the colorability is not sufficient, and colorability of the level of the matte coated paper has not been yet achieved.

As another ink jet recording medium than the above-described recording medium, there is also one obtained by coating the surfaces of pulp fibers with a water-soluble resin and a swellable resin as an ink-fixing agent and an ink-receiving agent. However, even by this method, interstices are left between pulp fibers after all, and thus the ink adsorption site thereof is limited, so that colorability has not been sufficient. In addition, this recording medium has involved a problem that the ink absorption capacity of the resulting ink receiving layer is small, and the absorption rate becomes low.

An ink jet recording medium obtained by forming silica on a substrate of pulp fibers and fixing pigment particles on to the silica has also been proposed (see Japanese Patent Application Laid-Open Nos. H04-298378 and 2003-276319). In this ink jet recording medium, when a water-based dye ink is used, the water-based dye ink is fixed to the silica, and so good colorability is achieved. However, the ink jet recording medium prepared by this technique has have a surface texture different from a feel of pulp like plain paper, and the surface texture thereof has been a feel like the so-called matte coated paper. The reason for this is that it is generally necessary to apply the silica to an ink receiving layer in a large amount of about 5 to 30 g/m$^2$.

Further, an ink jet recording medium obtained by controlling the amount of silica applied to an ink receiving layer to 1 to 3 g/m$^2$ smaller than the amount conventionally used and controlling the secondary particle size of the silica to from 3 μm or more and 30 μm or less has been proposed (see Japanese Patent Application Laid-Open No. 2002-046343). However, this recording medium does not have such a specific pore size region as shown in the present invention and fails to achieve colorability of the level of the matte coated paper for the water-based dye and pigment inks in spite of a feel like the plain paper.

Still further, an ink jet recording medium obtained by forming a thin layer of inorganic fine particles having a very fine particle size, such as alumina or dry silica, on a substrate of pulp fibers has been proposed (see Japanese Patent Application Laid-Open No. H09-095044). However, these inorganic fine particles are those used in the so-called glossy paper, and so a desired plain-paper-like feel is not obtained because glossiness develops on the surface of the resulting ink jet recording medium. In addition, a problem that the material cost is high has also been involved.

Yet still further, ink jet recording media for which ink-absorbing capacity and print density have been improved by controlling a pore volume of a specific pore size region formed in an ink receiving layer have been proposed (see Japanese Patent Application Laid-Open Nos. H10-324058 and H05-246131). However, these ink jet recording media have not been such that silica is applied in such a small amount (from 0.2 g/m$^2$ or more and 2.0 g/m$^2$ or less in terms of solid content mass) that a plain-paper-like feel can be realized. In addition, these recording media do not have such both pore size regions of a specific pore size region to be an adsorption site most suitable for water-based dye inks and a specific pore size region to be an adsorption site most suitable for water-based pigment inks, as shown in the present invention. From this reason, the recording media have failed to achieve colorability of the level of the matte coated paper for the water-based dye and pigment inks in spite of a feel like the plain paper.

In order to obtain a wide color reproduction range, it has been necessary to use a large amount of an ink in the conventional ink jet recording media. However, the use of the large amount of the ink has involved problems that it takes a long time for drying because a substrate (pulp fibers) absorbs water, and that cockling (waving) or curling occurs. In order to provide a printed article at low cost, also, it is better to lessen the amount of the ink required of the formation of an image, and so an ink jet recording medium capable of achieving high coloring by a small amount of an ink has been required. However, the ink jet recording medium capable of achieving high coloring by a small amount of an ink has not been yet realized.

SUMMARY OF THE INVENTION

The present invention has been made on the basis of the foregoing circumstances and has as its object the provision of an ink jet recording medium having a plain-paper-like feel and capable of achieving high colorability at the same level as that of matte coated paper.

The above object can be achieved by the present invention described below.

The present invention provides an ink jet recording medium comprising a substrate and an ink receiving layer which is provided on at least one surface of the substrate and contains inorganic fine particles having an average secondary particle size of 1 μm or more and 4 μm or less as measured by the Coulter counter method in an amount of 0.2 g/m$^2$ or more and 2.0 g/m$^2$ or less in terms of solid content mass, wherein the ink receiving layer satisfies the following conditions with respect to a pore distribution curve as determined by a nitrogen adsorption method, (1) total pore volume in a pore size range of 10 nm or more and 30 nm or less is 0.25 ml/g or more, (2) total pore volume in a pore size range of 30 nm or more and 70 nm or less is 0.1 ml/g or more, and (3) volume ratio of the total pore volume in the pore size range of 10 nm or more and 30 nm or less to the total pore volume in the pore size range of 30 nm or more and 70 nm or less is within a range of from 1:0.4 to 1:1.

Incidentally, the term "pore distribution curve" in the present specification represents a graph of which the axis of abscissa and the axis of ordinate indicate pore size and pore volume, respectively, as illustrated in FIG. 2, and the term "particle size distribution curve" in the present specification represents a graph of which the axis of abscissa and the axis of ordinate indicate pore size and number of particles, respectively.

The ink jet recording medium according to the present invention contains inorganic fine particles having an average secondary particle size of 1 μm or more and 4 μm or less in an amount of 0.2 g/m$^2$ or more and 2.0 g/m$^2$ or less in terms of solid content mass as the ink receiving layer. This amount is small compared with the content of inorganic fine particles in matte coated paper, so that an ink jet recording medium having a plain-paper-like feel can be provided.

In addition, the ink receiving layer has such a particular pore structure that both pores of specific small pores to be an adsorption site for dye and specific large pores to be an adsorption site for pigment particles are formed at a specific ratio by the inorganic fine particles. Accordingly, high colorability can be achieved at the same level as that of matte coated paper even when a printed article is formed with ether a water-based dye ink or a water-based pigment ink.

The ink jet recording medium according to the present invention may favorably use inorganic fine particles having an average secondary particle size of 1 μm or more and 3 μm or less. The relationship between the secondary particle size R (μm) of the inorganic fine particles and the solid content mass G (g/m$^2$) of the inorganic fine particles in the ink receiving layer may more favorably fall within a specific range ($0.3R \leqq G \leqq 1.0R$). By this constitution, the dot size of an ink upon printing becomes large, so that a region colored becomes large even with a small amount of the ink, and sufficiently high coloring can be achieved.

Further features of the present invention will become apparent from the following description of exemplary embodiments with reference to the attached drawings.

DETAILED DESCRIPTION OF THE INVENTION

Embodiments of the present invention will hereinafter be described with reference to the accompanying drawings.

<Ink Jet Recording Medium>

The ink jet recording medium according to the present invention has a substrate and an ink receiving layer which is provided on at least one surface of the substrate and contains inorganic fine particles in an amount of 0.2 g/m$^2$ or more and 2.0 g/m$^2$ or less in terms of solid content mass. The inorganic fine particles have an average secondary particle size of 1 μm or more and 4 μm or less as measured by the Coulter counter method.

Incidentally, the ink receiving layer provided on the substrate of the ink jet recording medium may be composed of a layer or a plurality of layers. The ink receiving layer may also be provided on one surface or both surfaces of the substrate.

Figure 1:
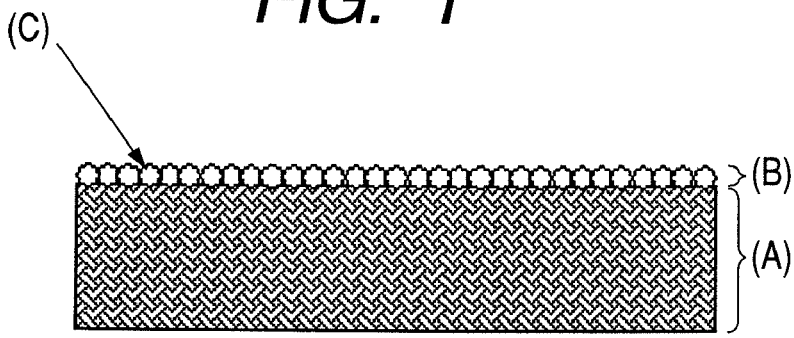
FIG. 1 is a cross-sectional view illustrating an exemplary ink jet recording medium according to the present invention, in which (A) is a substrate, (B) is an ink receiving layer, and (C) is inorganic fine particles.

FIG. 1 is a schematic cross-sectional view illustrating an exemplary ink jet recording medium according to the present invention, in which an ink receiving layer (B) containing inorganic fine particles (C) and a binder resin (not illustrated) is formed on one surface of a substrate (A).

In the ink jet recording medium according to the present invention, the ink receiving layer containing the inorganic fine particles (C) having an average secondary particle size of 1 μm or more and 4 μm or less in an amount of 0.2 g/m$^2$ or more and 2.0 g/m$^2$ or less in terms of solid content mass is provided on at least one surface of the substrate.

The ink receiving layer (B) will be described in more detail.

In order to obtain an ink jet recording medium having a plain-paper-like feel, it is necessary to form the ink receiving layer containing the inorganic fine particles in an extremely thin layer. If the content of the inorganic fine particles in the ink receiving layer is more than 2.0 g/m$^2$ in terms of solid content mass, the feel of the resulting ink jet recording medium consequently comes near to the feel of the so-called matte coated paper, and so desired properties cannot be achieved. As examples of "the plain-paper-like feel", may be mentioned such a condition that an irregular form is observed on the surface of the ink receiving layer by reflecting irregularities of pulp fibers in the substrate. However, the plain-paper-like feel is not limited to this condition.

If the content of the inorganic fine particles in the ink receiving layer is less than 0.2 g/m$^2$, the substrate cannot be completely covered with the inorganic fine particles without the portion that is not covered when the surface of the ink jet recording medium is observed from the above. As a result, high colorability, particularly, colorability of a dye ink cannot be achieved.

In the present invention, the ink receiving layer containing the inorganic fine particles in an amount of 0.2 g/m$^2$ or more and 2.0 g/m$^2$ or less in terms of solid content mass is formed, whereby the ink jet recording medium having high colorability and a plain-paper-like feel can be obtained. The solid content mass of the inorganic fine particles means the solid content mass of the inorganic fine particles in an ink receiving layer provided on one surface of the substrate. In other words, when the ink jet recording medium according to the present invention has the ink receiving layer on only one surface of the substrate, the solid content mass means that the solid content mass of the inorganic fine particles in the ink receiving layer is 0.2 g/m$^2$ or more and 2.0 g/m$^2$ or less. When the ink jet recording medium according to the present invention has the ink receiving layers on both surfaces of the substrate, the solid content mass means that the solid content mass of the inorganic fine particles in each ink receiving layer is 0.2 g/m$^2$ or more and 2.0 g/m$^2$ or less.

If inorganic fine particles having a large average secondary particle size exceeding 4 μm are used, the thickness of the resulting ink receiving layer inevitably becomes great when the inorganic fine particles are caused to be contained in the ink receiving layer in an amount sufficient to achieve desired coloring. As a result, the content of the inorganic fine particles becomes high, and the feel of the resulting ink jet recording medium comes near to that of matte coated paper.

If inorganic fine particles having a small average secondary particle size less than 1 μm are used, glossiness develops on the surface of the resulting ink jet recording medium, and ink absorbency is deteriorated, and so desired properties are not achieved.

The inorganic fine particles having an average secondary particle size of 1 μm or more and 4 μm or less are used in the ink jet recording medium according to the present invention, whereby the interstices between pulp fibers of the substrate can be filled even when the content of the inorganic fine particles is low.

As described above, in order to provide an ink jet recording medium having a plain-paper-like feel, it is necessary that the ink receiving layer satisfies the following conditions: (A) the ink receiving layer contains inorganic fine particles having an average secondary particle size of 1 μm or more and 4 μm or less; and (B) the content of the inorganic fine particles is 0.2 g/m$^2$ or more and 2.0 g/m$^2$ or less in terms of solid content mass.

The content of the inorganic fine particles in the ink receiving layer is favorably 0.5 g/m$^2$ or more and 1.5 g/m$^2$ or less, more favorably 0.7 g/m$^2$ or more and 1.0 g/m$^2$ or less in terms of solid content mass. The average secondary particle size of the inorganic fine particles is favorably 1.2 μm or more and 3 μm or less, more favorably 1.4 μm or more and 2 μm or less. The solid content mass and average secondary particle size of the inorganic fine particles fall within the respective above ranges, whereby the resulting ink jet recording medium can have far excellent high colorability while having a plain-paper-like feel.

In order to achieve high colorability at the same level as that of matte coated paper even when a printed article is formed with either a water-based dye ink or a water-based pigment ink, the ink receiving layer is required to have both pore structures of specific small pores to be an adsorption site for dye and specific large pores to be an adsorption site for pigment particles, at a specific ratio.

In the ink jet recording medium according to the present invention, the ink receiving layer thereof satisfies the following conditions: (1) total pore volume in a pore size range of 10 nm or more and 30 nm or less is 0.25 ml/g or more, (2) total pore volume in a pore size range of 30 nm or more and 70 nm or less is 0.1 ml/g or more, and (3) volume ratio of the total pore volume in the pore size range of 10 nm or more and 30 nm or less to the total pore volume in the pore size range of 30 nm or more and 70 nm or less, (total pore volume in the pore size range of 10 nm or more and 30 nm or less): (total pore volume in the pore size range of 30 nm or more and 70 nm or less), is within a range of from 1:0.4 to 1:1.

The reason why the ink receiving layer of the pore condition satisfying the above conditions (1) to (3) can achieve excellent coloring is considered to be as follows. An action at the time printing is conducted on the ink jet recording medium according to the present invention with a water-based pigment ink will be described below. The particle size of a pigment, which is a coloring material component of the pigment ink, is generally about 100 nm, and the pigment particles are dispersed in an ink solvent. Accordingly, when the water-based pigment ink is applied to the ink receiving layer by an ink jet recording system, this ink penetrates into large pores of from several microns to several tens microns in the ink receiving layer after the impacts on the ink receiving layer. The solvent component of the ink then further penetrates into small pores having a pore size of 10 nm or more and 30 nm or less. On the other hand, the particle size of the pigment particles, which are a coloring material component, is about 100 nm, and most of the pigment particles are considered to be adsorbed on pores having a pore size of 30 nm or more and 70 nm or less. The pigment particles are considered to be successively stacked on the pigment particles which are previously fixed and function as a foothold. However, it is considered that if the pore size of the pores in the ink receiving layer exceeds 70 nm, the pigment particles are hard to be fixed to peripheries of such pores or fall in the interiors of the pores to deteriorate colorability.

An action at the time printing is conducted on the ink jet recording medium according to the present invention with a water-based dye ink will now be described below. A dye component is generally dissolved in an ink solvent. Accordingly, the dye ink ejected toward the ink receiving layer by an ink jet recording system first penetrates into large pores of from several microns to several tens microns in the ink receiving layer after the ink impacts on the ink receiving layer. It is considered that the dye particles, which are a coloring material component, further penetrate into and are adsorbed on small pores of 10 nm or more and 30 nm or less in amorphous silica together with a solvent component. However, if the pore size is 10 nm or less, the ink may be hard in some cases to be absorbed in or fixed to such pores. If the pore size is 30 nm or more, the absorption rate of the ink into the ink receiving layer may be lowered, or the dye component may penetrate into a deeper portion of the ink receiving layer in some cases. It is consequently considered that colorability is deteriorated.

Even if pores having a pore size ranging from 30 nm or more and 70 nm or less for fixing the pigment and pores having a pore size ranging from 10 nm or more and 30 nm or less for fixing the dye exist in the ink receiving layer as described above, the ink receiving layer cannot stably fix both water-based pigment ink and water-based dye ink when the existing amount (pore volume) of any one thereof is small. In the present invention, both pores of specific small-size pores to be an adsorption site for dye and specific large-size pores to be an adsorption site for pigment particles are formed at the specific pore volume ratio described in the above (3). It is considered that high colorability can by thereby achieved at the same level as that of matte coated paper even when a printed article is formed with either a water-based dye ink or a water-based pigment ink.

Incidentally, if the ratio of the total pore volume of pores in the pore size range of 10 nm or more and 30 nm or less to the total pore volume of pores in the pore size range of 30 nm or more and 70 nm or less falls outside the condition (3), such an ink receiving layer gives coloring of the water-based dye ink but may not achieve desired colorability for the water-based pigment ink in some cases. On the contrary, coloring is achieved for the water-based pigment ink but desired colorability may not be achieved for the water-based dye ink in some cases. As described above, the desired colorability may not be achieved for both water-based dye ink and water-based pigment ink in some cases.

The total pore volume in the pore size range of 10 nm or more and 30 nm or less is favorably 0.3 ml/g or more, more favorably 0.4 ml/g or more, and is also favorably 2.0 ml/g or less, more favorably 1.0 ml/g or less. The total pore volume in the pore size range of 30 nm or more and 70 nm or less is favorably 0.2 ml/g or more, more favorably 0.3 ml/g or more, and is also favorably 2.0 ml/g or less, more favorably 1.0 ml/g or less. The volume ratio of the total pore volume in the pore size range of 10 nm or more and 30 nm or less to the total pore volume in the pore size range of 30 nm or more and 70 nm or less, (total pore volume in the pore size range of 10 nm or more and less than 30 nm):(total pore volume in the pore size range of 30 nm or more and 70 nm or less), is favorably within a range of from 1:0.5 to 1:0.9, more favorably from 1:0.6 to 1:0.8.

As described above, (1) the total pore volume in the pore size range of 10 nm or more and less than 30 nm, (2) the total pore volume in the pore size range of 30 nm or more and 70 nm or less, and (3) the ratio between these total pore volumes fall within the above respective ranges, whereby the water-based dye ink and the water-based pigment ink can be more effectively fixed to the ink receiving layer.

Figure 2:
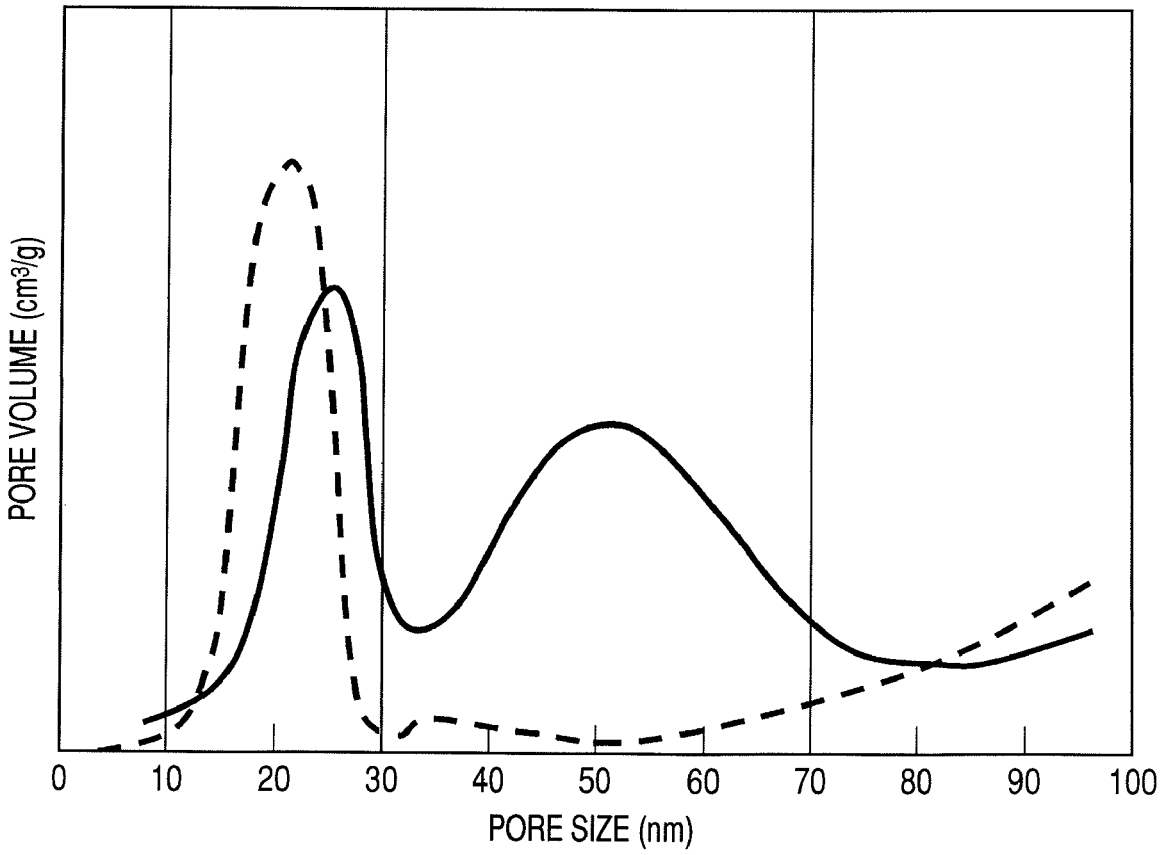
FIG. 2 is a graph illustrating respective pore distribution curves of ink receiving layers of an ink jet recording medium according to the present invention and a conventional ink jet recording medium.

FIG. 2 is a graph illustrating the pore distribution curves of the ink jet recording medium according to the present invention and a conventional ink jet recording medium, in which a broken line is an example of the conventional ink jet recording medium, and a solid line is an example of the ink jet recording medium according to the present invention. As apparent from the graph in FIG. 2, in the conventional ink jet recording medium, the pore distribution curve mainly has a peak in a pore size range of 10 nm or more and 30 nm or less, and fixing of an ink component is conducted by this pore size portion. On the other hand, in the ink jet recording medium according to the present invention, the pore distribution curve has two peaks in both regions of a pore size range of 10 nm or more and 30 nm or less and a pore size range of 30 nm or more and 70 nm or less, and the total pore volume in the pore size range of 10 nm or more and 30 nm or less and the total pore volume in the pore size range of 30 nm or more and 70 nm or less have the features (1) to (3) described above.

As described above, the ink jet recording medium according to the present invention is different from the conventional ink jet recording medium in the pore structure of the ink receiving layer represented by the features (1) to (3). Incidentally, in FIG. 2, the example having the 2 peaks in the pore distribution curve has been illustrated. However, the pore distribution curve of the ink jet recording medium according to the present invention may have no peak, or one peak or three or more peaks. Even in such a case, it is necessary for the ink receiving layer to have the pore structure represented by the features (1) to (3).

Incidentally, the pore structure represented by the features (1) to (3) can be formed by controlling a preparation process of the inorganic fine particles, the kinds of other materials than the inorganic fine particles in the ink receiving layer, the composition of the ink receiving layer, and a process for forming the ink receiving layer (for example, a coating process a drying process and a drying rate of a coating liquid for the ink receiving layer).

The inorganic fine particles favorably satisfy the following conditions with respect to a pore distribution curve of the inorganic fine particles as determined by the nitrogen adsorption method, (4) total pore volume in a pore size range of 10 nm or more and 30 nm or less is 1 ml/g or more, (5) total pore volume in a pore size range of 30 nm or more and 70 nm or less is 0.1 ml/g or more, and (6) volume ratio of the total pore volume in the pore size range of 10 nm or more and 30 nm or less to the total pore volume in the pore size range of 30 nm or more and 70 nm or less, (total pore volume in the pore size range of from 10 nm or more and 30 nm or less):(total pore volume in the pore size range of from 30 nm or more and 70 nm or less), is within a range of from 1:0.1 to 1:1.

The pore properties (4) to (6) of the inorganic fine particles can be measured by a method described in the Examples and are properties relating to pore structures not only in the interiors of the inorganic fine particles but also between the inorganic fine particles.

Incidentally, the inorganic fine particles having the pore properties (4) to (6) can be produced by a publicly known process. As an example, a case where amorphous silica is produced as inorganic fine particles will be described below. Sulfuric acid is added into an aqueous solution (liquid temperature: 20 to 40° C.) of silicate of soda containing $Na_2SO_4$ to conduct neutralization (neutralization rate: 30 to 70%). After the aqueous solution is then heated to a temperature of 70 to 100° C. and aged for 5 to 90 minutes, sulfuric acid is added to a pH of 2 to 4 to complete the reaction. The reaction product is then dried to remove the solvent such as water. After amorphous silica is obtained in such a manner and then subjected to filtration, water washing and drying, the amorphous silica is further ground and classified to a desired particle size.

In the production process of the amorphous silica, the reaction temperature, the neutralization rate with sulfuric acid and the time for addition thereof, the concentration of $SiO_2$, the concentration of $Na_2SO_4$, conditions of grinding and classification, and the like are suitably adjusted, whereby the pore size distribution and the pore volume of primary particles, and the average secondary particle size can be controlled to respective desired values.

The inorganic fine particles contained in the ink receiving layer have the properties (4) to (6), whereby the pore structures of the ink receiving layer represented by the features (1) to (3) can be realized as pore structures within the inorganic fine particles and between the inorganic fine particles.

Incidentally, the pore structure of the ink receiving layer represented by the feature (1) is considered to be greatly affected mainly by the pore structure within the inorganic fine particles. On the other hand, the pore structure of the ink receiving layer represented by the feature (2) is considered to be greatly affected mainly by the pore structure between the inorganic fine particles.

In a particle size distribution curve of the inorganic fine particles as determined by the Coulter counter method, 15% by number of particles or more of all the inorganic fine particles are favorably present in a pore size range of 0.1 μm or more and 1 μm or less. A large number of the inorganic fine particles are present in the pore size range of 0.1 μm or more and 1 μm or less as described above, whereby the pore structures of the ink receiving layer represented by the features (1) to (3) can be realized as the pore structure between the inorganic fine particles, the pore structure within the inorganic fine particles or a pore structure both between and within the inorganic fine particles.

The ink jet recording medium according to the present invention favorably uses inorganic fine particles having an average secondary particle size of 1 μm or more and 3 μm or less. The particle size R (μm) of the inorganic fine particles and the solid content mass G ($g/m^2$) of the inorganic fine particles in the ink receiving layer are favorably defined so as to satisfy the relationship ($0.3R \leqq G \leqq 1.0R$) between them. By this constitution, a dot size of an ink upon printing becomes large, so that a region colored becomes large even with a small amount of the ink, and sufficiently high coloring can be achieved. The reason why the dot size of the ink upon printing becomes large is presumed to be as follows.

In this ink jet recording medium, the solid content mass G ($g/m^2$) of the inorganic fine particles in the ink receiving layer is set small, so that the structure of the ink receiving layer is such that the layer thickness of the ink receiving layer becomes thin, and so the ink cannot be completely absorbed or fixed by the ink receiving layer alone upon printing. Accordingly, the ink remaining without being absorbed or fixed by the ink receiving layer comes to reach an interface between the substrate and the ink receiving layer. The absorption rate of the ink at the interface is slower than the rate at the ink receiving layer, and so the ink overflows in the interface. As a result, it is presumed that the ink overflowed spreads over toward a lateral direction of the ink receiving layer, and so the dot size becomes large.

According to this constitution, the layer thickness of the ink receiving layer is thin, i.e., the number of layers of the inorganic fine particles stacked is small, so that scattering of incident light is suppressed to a small amount to enhance the transparency of the ink receiving layer. Accordingly, the visibility of the ink adsorbed on the inorganic fine particles is made high, and reflected light from the substrate (pulp fibers) can easily be obtained to achieve sufficiently high coloring.

If G is more than 1.0R, the number of layers of the inorganic fine particles stacked becomes large. Therefore, a large dot size cannot be achieved, light scattering within the ink receiving layer becomes great, and reflected light by the substrate (pulp fibers) is also hard to be obtained. Accordingly, the resulting ink jet recording medium is hard to achieve high coloring with a small amount of an ink.

If G is less than 0.3R on the other hand, the resulting ink jet recording medium comes to have less adsorption sites for dye and pigment and is thus hard to achieve sufficient coloring even with a large amount of an ink.

The material constitution of respective layers of the ink jet recording medium according to the present invention illustrated in FIG. 1 will now be described.

<Substrate (A)>

The substrate used in the present invention can be obtained by, for example, the following process. A pulp stock such as cotton pulp, hemp pulp, paper bush pulp, paper mulberry pulp, straw pulp, bamboo pulp, bagasse pulp, reed pulp, wood pulp or waste paper pulp is used as a raw material, any of various kinds of fillers such as calcium carbonate, talc, clay and kaolin, a binder such as starch or PVA, a sizing agent, a fixing agent, a retention aid and a paper strengthening agent are suitably blended with the pulp stock to prepare a paper stuff. This paper stuff is made acidic, neutral or alkaline and then subjected to paper making by means of a paper machine such as a Fourdrinier paper machine, cylinder paper machine or twin-wire paper machine. The substrate (A) obtained in such a manner may be further subjected to various kinds of calendaring treatments to obtain necessary surface properties and density.

<Ink Receiving Layer (B)>

(1) Inorganic Fine Particles (C)

Examples of the inorganic fine particles (C) added into the ink receiving layer (B) include amorphous silica, alumina, alumina-silica composite sol, calcium carbonate, kaolin and clay. These inorganic fine particles may be used either singly or in any combination thereof.

Among these inorganic fine particles (C), amorphous silica is favorably used because the pore structure within the inorganic fine particles can be easily controlled, and a large number of pores can be formed in the pore size range of 10 nm or more and 30 nm or less and the pore size range of 30 nm or more and 70 nm or less. Examples of amorphous silica include dry process silica, vapor-phase process silica, sol process silica (colloidal silica) and wet process silica belonging to that of precipitation process and gel process. In particular, the wet process silica may favorably be used for achieving the effects of the present invention with a material of low cost as much as possible.

The oil absorption of the amorphous silica is favorably 200 $cm^3$/100 g or more. The amorphous silica whose oil absorption is 200 $cm^3$/100 g or more is used as the inorganic fine particles (C), whereby the resulting ink jet recording medium can have excellent image properties after printing. Incidentally, the oil absorption can be measured according to JIS K 5101-13-2.

(2) Binder

As another material for forming the ink receiving layer (B), a water-soluble resin or emulsion resin may be used as a binder. Examples of usable water-soluble resins include polyvinyl alcohol and modified products thereof, polyvinyl acetal, polyacrylonitrile, vinyl acetate, oxidized starch, etherified starch, casein, gelatin, carboxymethyl cellulose, SB latexes, NB latexes, acrylic latexes, ethylene-vinyl acetate latexes, polyurethane, unsaturated polyester resins, and acrylic resins.

Among these binders, polyvinyl alcohol is favorably used from the viewpoints of ink absorbency and strength of an ink receiving layer to be formed. The content thereof in the ink receiving layer (B) is favorably 5% by mass or more and 35% by mass or less based on the total solid content mass. The content of polyvinyl alcohol in the ink receiving layer (B) falls within this range, whereby the mechanical strength of the ink receiving layer (B) can be made high, and such an ink receiving layer can retain good ink absorbency.

Examples of usable emulsion resins include acrylic, urethane, polyester, ethylene-vinyl acetate and styrene-butadiene copolymers and modified products thereof. These binders may be used either singly or in any combination thereof.

(3) Other Additive Materials

Besides the above-described components, a pH adjustor, a water-proofing agent, a pigment dispersant, a thickener, an antifoaming agent, a foam suppressor, a parting agent, a fluorescent dye, an optical whitening agent, an ultraviolet absorbent, an antioxidant, a surfactant, a preservative, an ink fixing agent, a cationic resin and a penetrant may further be used in the ink receiving layer (B) as needed so far as no detrimental influence is thereby imposed on the effects of the present invention.

(4) P/B Ratio

The content of the inorganic fine particles in the ink receiving layer (B) is favorably 40% by mass or more and 80% by mass or less, more favorably 50% by mass or more and 70% by mass or less. If the content of the inorganic fine particles is more than 80% by mass, the film strength of the ink receiving layer may be lowered, and dusting of the inorganic fine particles may occur by rubbing of the surface of the ink jet recording medium in some cases. If the content of the inorganic fine particles is less than 40% by mass on the other hand, the ink absorbing capacity and absorbing rate of the resulting ink receiving layer may be lowered to fail to obtain a good printed image.

<Application System of Coating Liquid for Ink Receiving Layer>

The ink receiving layer can be obtained by preparing a coating liquid containing the materials described in <Ink receiving layer (B)> and then applying this coating liquid on to the substrate. As a method for applying this coating liquid, may be used, for example, an air knife coating, gravure coating, blade coating, bar coating, roll coating, rod bar coating, slot die coating, curtain coating or size pressing method. Incidentally, the application of the coating liquid may be conducted by an on-line system during a paper making step for the substrate or by an off-line system after the paper making. The coating liquid for forming the ink receiving layer is applied so as to give a dry coat weight of favorably 0.1 $g/m^2$ or more, more favorably 0.5 $g/m^2$ or more, and also to give a dry coat weight of favorably 4.0 $g/m^2$ or less, more favorably 2.0 $g/m^2$ or less.

<Ink Jet Recording Method>

The ink jet recording method according to the present invention is a method in which a water-based ink is applied to an ink receiving layer side to form an image. As a specific method thereof, any method may be used so far as the method is a method capable of effectively ejecting the ink from a minute orifice (nozzle) to apply the ink to the ink jet recording medium. Among others, the method described in Japanese Patent Application Laid-Open No. S54-059936 may be particularly effectively used. In this method, an ink undergoes a rapid volumetric change by an action of thermal energy applied to the ink, and the ink is ejected out of a nozzle by working force generated by this volumetric change. Incidentally, in this ink jet recording method, a water-based dye ink or a water-based pigment ink may be used singly as the water-based ink, or both water-based dye ink and water-based pigment ink may be used in combination.

<Water-Based Ink for Ink Jet Recording>

Water-based inks used in the ink jet recording method according to the present invention include a water-based dye ink and a water-based pigment ink. The water-based inks used in conducting recording on the ink jet recording medium according to the present invention by the ink jet recording method will hereinafter be described.

(Water-Based Dye Ink)

For the water-based dye ink used in the present invention, any dye may be used without particular limitation so far as the dye is a water-soluble acid dye, direct dye or reactive dye described in, for example, "Color Index". Dyes not described in the Color Index may also be used without particular limitation so far as such dyes have an anionic group, for example, a sulfonic or carboxyl group. Such water-based inks used in the present invention as described above may further contain water, a water-soluble organic solvent and other components, for example, a viscosity modifier, a pH adjustor, a preservative, a surfactant and an antioxidant, as needed.

(Water-Based Pigment Ink)

The water-based pigment ink used in the present invention contains water and a pigment, and besides contains a water-soluble organic solvent and other components as needed. In the water-based pigment ink, for example, a viscosity modifier, a pH adjustor, a preservative, a surfactant and an antioxidant are contained as needed. Besides the above-described various components, an anionic compound such as an anionic surfactant or anionic polymer is favorably contained. An amphoteric surfactant may also be contained with the pH thereof adjusted to a pH not lower than the isoelectric point thereof.

As examples of the anionic surfactant used at this time, may be mentioned surfactants generally used, such as carboxylic acid salt type, sulfuric acid ester type, sulfonic acid salt type and phosphoric acid salt type. As examples of the anionic polymer, may be mentioned alkali-soluble resins, specifically, sodium polyacrylate and those obtained by copolymerizing acrylic acid at a part of a polymer. However, the present invention is not limited thereto.

The content of the pigment in the water-based pigment ink used in the ink jet recording method according to the present invention is favorably 1% by mass or more and 20% by mass or less, more favorably 2% by mass or more and 12% by mass or less based on the total mass of the ink.

As an example of a pigment used in a black ink, may be mentioned carbon black. As such carbon black, may favorably be used those produced according to the furnace process or channel process and having such properties that the primary particle size is 15 μm or more and 40 μm or less, the specific surface area is 50 $m^2/g$ or more and 300 $m^2/g$ or less as measured according to the BET method, the oil absorption is 40 $cm^3/100$ g or more and 150 $cm^3/100$ g or less as measured by using DBP, the volatile matter is 0.5% by mass or more and 10% by mass or less, and the pH value is 2 or more and 9 or less.

As examples of commercially-available carbon black having such properties as described above, may be mentioned No. 2300, No. 900, MCF88, No. 33, No. 40, No. 45, No. 52, MA7, MA8 and No. 2200B (all, products of Mitsubishi Chemical Corporation), RAVEN 1255 (product of Columbian Co.), REGAL 400R, REGAL 330R, REGAL 660R and MOGUL L (all, products of Cabot Company), and Color Black FW1, Color Black FW18, Color Black S170, Color Black S150, Printex 35 and Printex U (all, products of Degussa Co.).

As examples of a pigment used in a yellow ink, may be mentioned C.I. Pigment Yellow 1, C.I. Pigment Yellow 2, C.I. Pigment Yellow 3, C.I. Pigment Yellow 13, C.I. Pigment Yellow 16 and C.I. Pigment Yellow 83. As examples of a pigment used in a magenta ink, may be mentioned C.I. Pigment Red 5, C.I. Pigment Red 7, C.I. Pigment Red 12, C.I. Pigment Red 48(Ca), C.I. Pigment Red 48(Mn), C.I. Pigment Red 57(Ca), C.I. Pigment Red 112 and C.I. Pigment Red 122.

As examples of a pigment used in a cyan ink, may be mentioned C.I. Pigment Blue 1, C.I. Pigment Blue 2, C.I. Pigment Blue 3, C.I. Pigment Blue 15:3, C.I. Pigment Blue 16, C.I. Pigment Blue 22, C.I. Vat Blue 4 and C.I. Vat Blue 6. However, the pigments used in the water-based pigment inks are not limited to those described above. Needless to say, pigments newly prepared for the present invention may also be used in addition to the pigments mentioned above.

As a dispersant contained in the water-based pigment ink, any dispersant may be used so far as it is a water-soluble resin. Among others, a dispersant having a weight-average molecular weight of 1,000 or more and 30,000 or less, favorably 3,000 or more and 15,000 or less is more favorably used.

Specific examples of such a dispersant include block copolymers, random copolymers or graft copolymers comprised of at least 2 monomers (at least one thereof is a hydrophilic monomer) selected from the group consisting of styrene, styrene derivatives, vinylnaphthalene, vinylnaphthalene derivatives, aliphatic alcohol esters of α,β-ethylenically unsaturated carboxylic acids, acrylic acid, acrylic acid derivatives, maleic acid, maleic acid derivatives, itaconic acid, itaconic acid derivatives, fumaric acid, fumaric acid derivatives, vinyl acetate, vinylpyrrolidone, and acrylamide and derivatives thereof, and salts thereof. Natural resins such as rosin, shellac and starch may also be favorably used. These resins are soluble in an aqueous solution with an alkali dissolved therein and are alkali-soluble resins. These water-soluble resins used as pigment dispersants are favorably contained in the water-based pigment ink in an amount of 0.1% by mass or more and 5% by mass or less based on the total mass of the ink.

The water-based pigment ink according to the present invention is favorably adjusted to a neutral or alkaline pH. By adjusting the ink in such a manner, the solubility of the water-soluble resin used as a pigment dispersant is improved and the ink is made excellent in long-term storage stability. The pH of the water-based pigment ink is favorably adjusted to from 7 or more and 10 or less.

Examples of a pH adjustor used for adjusting the pH of the water-based pigment ink include various kinds of organic amines such as diethanolamine and triethanolamine, inorganic alkalis, such as alkali metal hydroxides such as sodium hydroxide lithium hydroxide and potassium hydroxide, organic acids, and mineral acids. The present invention will hereinafter be described more specifically by the following Examples.

EXAMPLES

Inorganic Fine Particles

The features of inorganic fine particles used in the Examples and Comparative Examples are shown in Table 1. Incidentally, the average secondary particle size and particle size distribution curve of each of the inorganic fine particle samples were determined by using a sample liquid with 0.01 g of the inorganic fine particles subjected to ultrasonic dispersion (for 10 minutes) in 20 ml of methanol according to the Coulter counter method using a precision particle size distribution measuring apparatus (TA2 type). The oil absorption of an inorganic fine particle sample was measured according to JIS K 5101-13-2.

And besides the pore volume and the pore volume ratio of amorphous silica powders A, B, C, D and K are shown in Table 2. These properties were determined by means of a pore distribution measuring apparatus (TriStar 3000; manufactured by SHIMAZU CORP.) after each amorphous silica powder (0.04 g) charged into a glass cell (Cell ⅜; manufactured by SHIMAZU CORP.) was purged with nitrogen using a nitrogen purging device (Micromeritics VacPrep 061; manufactured by SHIMAZU CORP.). At this time, the amount charged is set to be 0.01 g or more, whereby the inorganic fine particles can be charged in an amount sufficient to contact one another to determine the pore distributions within and between the inorganic fine particles.

TABLE 1

| | Average secondary particle size (μm) | Proportion of particles having a particle size of 0.1 to 1 μm (% by number of particles) | Oil absorption ($cm^3$/100 g) |
|---|---|---|---|
| Amorphous silica powder A | 1.6 | 23 | 240 |
| Amorphous silica powder B | 1.6 | 10 | 240 |
| Amorphous silica powder C | 3.0 | 20 | 220 |

TABLE 1-continued

| | Average secondary particle size (μm) | Proportion of particles having a particle size of 0.1 to 1 μm (% by number of particles) | Oil absorption ($cm^3$/100 g) |
|---|---|---|---|
| Amorphous silica powder D | 1.8 | 17 | 240 |
| Amorphous silica powder E | 0.6 | 70 | 100 |
| Amorphous silica powder F | 6.0 | 10 | 240 |
| Amorphous silica powder G | 12.0 | 2 | 240 |
| Amorphous silica powder H | 1.4 | 20 | 100 |
| Amorphous silica powder I | 3.0 | 5 | 220 |
| Amorphous silica powder J | 2.5 | 18 | 150 |
| Amorphous silica powder K | 3.3 | 10 | 240 |

TABLE 2

| | Pore volume (ml/g) | | |
|---|---|---|---|
| | 10 nm or more and 30 nm or less | 30 nm or more and 70 nm or less | Pore volume ratio |
| Amorphous silica powder A | 1.16 | 0.45 | 1:0.39 |
| Amorphous silica powder B | 1.12 | 0.32 | 1:0.28 |
| Amorphous silica powder C | 1.29 | 0.18 | 1:0.14 |
| Amorphous silica powder D | 1.17 | 0.31 | 1:0.27 |
| Amorphous silica powder K | 1.30 | 0.14 | 1:0.11 |

Example 1

Preparation of Coating Liquid

Amorphous silica powder A was mixed with ion-exchanged water under stirring to obtain an amorphous silica dispersion having a solid content concentration of 15% by weight. One hundred parts by mass of this amorphous silica dispersion was mixed with 58 parts by mass of a 10% by weight aqueous solution of polyvinyl alcohol (product of JAPAN VAM & POVAL CO., LTD.; JC-25 (trade name)) and 15 parts by mass of a 20% by weight aqueous solution of a cationic resin (polyallylamine hydrochloride), and the resultant mixture was stirred. The mixture was then diluted with ion-exchanged water to obtain a coating liquid 1 having a solid content concentration of 13% by weight.

Paper Making and Formation of Ink Receiving Layer

Neutral pulp base paper having a basis weight of 80 $g/m^2$ was used as a substrate, and the coating liquid prepared above was applied on to this substrate and dried so as to give a dry coat weight of 1.5 $g/m^2$, thereby obtaining an ink jet recording medium having the substrate and an ink receiving layer.

Example 2

An ink jet recording medium having a substrate and an ink receiving layer was obtained in the same manner as in Example 1 except that amorphous silica powder B was used in place of the amorphous silica powder A.

Example 3

An ink jet recording medium having a substrate and an ink receiving layer was obtained in the same manner as in Example 1 except that amorphous silica powder C was used in place of the amorphous silica powder A.

Example 4

An ink jet recording medium having a substrate and an ink receiving layer was obtained in the same manner as in Example 1 except that amorphous silica powder D was used in place of the amorphous silica powder A, and the coating liquid was applied and dried so as to give a dry coat weight of 2.8 g/m$^2$.

Example 5

An ink jet recording medium having a substrate and an ink receiving layer was obtained in the same manner as in Example 1 except that amorphous silica powder A was used, and the coating liquid was applied and dried so as to give a dry coat weight of 2.8 g/m$^2$.

Example 6

An ink jet recording medium having a substrate and an ink receiving layer was obtained in the same manner as in Example 1 except that amorphous silica powder A was used, and the coating liquid was applied and dried so as to give a dry coat weight of 0.6 g/m$^2$.

Example 7

An ink jet recording medium having a substrate and an ink receiving layer was obtained in the same manner as in Example 1 except that amorphous silica powder K was used in place of the amorphous silica powder A, and the coating liquid was applied and dried so as to give a dry coat weight of 3.1 g/m$^2$.

Comparative Example 1

The same neutral pulp base paper as that used as the substrate in Example 1 was used as it is without providing an ink receiving layer, thereby obtaining an ink jet recording medium.

Comparative Example 2

Only a 20% by weight aqueous solution of a cationic resin (polyallylamine hydrochloride) was diluted with ion-exchanged water to obtain a coating liquid 2 having a solid content concentration of 5% by weight in place of the coating liquid 1. This coating liquid 2 was applied and dried so as to give a dry coat weight of 0.2 g/m$^2$, thereby obtaining an ink jet recording medium having a substrate and an ink receiving layer Comparative Example 3

An ink jet recording medium having a substrate and an ink receiving layer was obtained in the same manner as in Example 1 except that amorphous silica powder E was used in place of the amorphous silica powder A.

Comparative Example 4

An ink jet recording medium having a substrate and an ink receiving layer was obtained in the same manner as in Example 1 except that amorphous silica powder F was used in place of the amorphous silica powder A.

Comparative Example 5

An ink jet recording medium having a substrate and an ink receiving layer was obtained in the same manner as in Example 1 except that amorphous silica powder G was used in place of the amorphous silica powder A.

Comparative Example 6

An ink jet recording medium having a substrate and an ink receiving layer was obtained in the same manner as in Example 1 except that the coating liquid 1 was applied and dried so as to give a dry coat weight of 0.2 g/m$^2$.

Comparative Example 7

An ink jet recording medium having a substrate and an ink receiving layer was obtained in the same manner as in Example 1 except that the coating liquid 1 was applied and dried so as to give a dry coat weight of 7.7 g/m$^2$.

Comparative Example 8

An ink jet recording medium having a substrate and an ink receiving layer was obtained in the same manner as in Example 1 except that amorphous silica powder H was used in place of the amorphous silica powder A.

Comparative Example 9

An ink jet recording medium having a substrate and an ink receiving layer was obtained in the same manner as in Example 1 except that amorphous silica powder I was used in place of the amorphous silica powder A.

Comparative Example 10

An ink jet recording medium having a substrate and an ink receiving layer was obtained in the same manner as in Example 1 except that amorphous silica powder J was used in place of the amorphous silica powder A.

Comparative Example 11

An ink jet recording medium having a substrate and an ink receiving layer was obtained in the same manner as in Example 1 except that amorphous silica powder F was used in place of the amorphous silica powder A, and the coating liquid was applied and dried so as to give a dry coat weight of 7.7 g/m$^2$.

Evaluation of Properties:

The ink jet recording media obtained in the above-described manner were evaluated as to the following properties.

<Pore Distribution>

With respect to the ink receiving layer of each of the resultant ink jet recording media, the pore distribution thereof was determined by the nitrogen adsorption method to calculate the following values (I) to (III): (I) total pore volume in a pore size range of 10 nm or more and 30 nm or less, (II) total pore volume in a pore size range of 30 nm or more and 70 nm or less, and (III) pore volume ratio between the values (I) and (II).

Incidentally, the pore distribution was determined by means of a pore distribution measuring apparatus (TriStar 3000; manufactured by SHIMAZU CORP.) after an ink jet recording medium sample (of the amount containing 0.04-g of the receiving layer) charged into a glass cell (Cell ⅜; manufactured by SHIMAZU CORP.) was purged with nitrogen using a nitrogen purging device (Micromeritics VacPrep 061; manufactured by SHIMAZU CORP.).

Here, the pore volume of the substrate alone in the ink jet recording medium was measured as a preliminary experiment. As a result, the pore volume in a pore size range of 10 nm or more and 70 nm or less was extremely minute as follows: (a) total pore volume in a pore size range of 10 nm or more and 30 nm or less: 0.002 $cm^3/g$, and (b) total pore volume in a pore size range of 30 nm or more and 70 nm or less: 0.003 $cm^3/g$.

Accordingly, in the pore distribution of the ink receiving layer in the ink jet recording medium as determined in the above-described manner, the pore volume in the pore size range of 10 nm or more and 70 nm or less of the substrate was regarded as 0. The calculation was made assuming that the ink receiving layer alone was subjected to the determination by deducting the weight of the substrate from the total weight of the test sample, i.e. ignoring the weight of the substrate, though the whole test sample of the ink jet recording medium including the substrate was subjected to the determination.

<Surface Texture>

The surface texture of each of the resultant ink jet recording media was visually evaluated according to the following criteria: A: a feel equivalent to plain paper (LFM-PP360S, product of Canon Inc.); B: a feel different from plain paper (LFM-PP360S, product of Canon Inc.), (being slightly glossy or having a matte-paper-like feel).

<Pigment Colorability, Dye Colorability>

"image PROGRAF 500" (trade name, manufactured by Canon Inc.) as a printer for water-based dye inks and "image PROGRAF 5000" (trade name, manufactured by Canon Inc.) as a printer for water-based pigment inks were used, and solid images (1200 D, 2400 dpi) were printed in applied ink quantities of 50% and 100% on each of the ink jet recording media obtained above with a pigment cyan ink (PFI-101 C, trade name) and a dye cyan ink (PFI-102 C, trade name). Thereafter, each of the resultant printed articles was left to stand for 24 hours in a room to sufficiently dry them, and the print density of the printed surface of the ink jet recording medium was measured. Incidentally, Spectrodensitometer (500 Series; manufactured by X Rite Inc.) was used for this measurement. At this time, the print density thus measured was evaluated as follows: (1) In the case of the applied ink quantity of 100% as to the water-based dye ink; E: less than 1.2, D: 1.2 or more and less than 1.3, C, 1.3 or more and less than 1.4, B: 1.4 or more and less than 1.5, and A: 1.5 or more; (2) In the case of the applied ink quantity of 100% as to the water-based pigment ink, E: less than 1.1, D: 1.1 or more and less than 1.2, C, 1.2 or more and less than 1.3, B: 1.3 or more and less than 1.35, and A: 1.35 or more; (3) In the case of the applied ink quantity of 50% as to the water-based dye ink, D: less than 1.0, B: 1.0 or more and less than 1.3, and A: 1.3 or more; and (4) In the case of the applied ink quantity of 50% as to the water-based pigment ink, D: less than 0.9, B: 0.9 or more and less than 1.0, and A: 1.0 or more.

The evaluation results are shown in Tables 3 and 4.

TABLE 3

| | Feature of inorganic fine particles | | | | | |
|---|---|---|---|---|---|---|
| | Kind | Average secondary particle size R (μm) | Solid content mass G ($g/m^2$) | Dry weight of ink receiving layer ($g/m^2$) | Proportion of particles of 0.1 to 1 μm (% by number) | Oil absorption ($cm^3$/100 g) |
| Ex. 1 | Amorphous silica powder A | 1.6 | 0/95 | 1.5 | 23 | 240 |
| Ex. 2 | Amorphous silica powder B | 1.6 | 0.95 | 1.5 | 10 | 240 |
| Ex. 3 | Amorphous silica powder C | 3.0 | 0.95 | 1.5 | 20 | 220 |
| Ex. 4 | Amorphous silica powder D | 1.8 | 1.78 | 2.8 | 17 | 240 |
| Ex. 5 | Amorphous silica powder A | 1.6 | 1.8 | 2.8 | 23 | 240 |
| Ex. 6 | Amorphous silica powder A | 1.6 | 0.4 | 0.6 | 23 | 240 |
| Ex. 7 | Amorphous silica powder K | 3.3 | 2.0 | 3.1 | 10 | 240 |
| Comp. Ex. 1 | — | Not added | Not added | — | — | — |
| Comp. Ex. 2 | — | Not added | Not added | — | — | — |
| Comp. Ex. 3 | Amorphous silica powder E | 0.6 | 0.95 | 1.5 | 70 | 100 |
| Comp. Ex. 4 | Amorphous silica powder F | 6.0 | 0.95 | 1.5 | 10 | 240 |
| Comp. Ex. 5 | Amorphous silica powder G | 12.0 | 0.95 | 1.5 | 2 | 240 |
| Comp. Ex. 6 | Amorphous silica powder A | 1.6 | 0.1 | 0.2 | 23 | 240 |
| Comp. Ex. 7 | Amorphous silica powder A | 1.6 | 5.0 | 7.7 | 23 | 240 |
| Comp. Ex. 8 | Amorphous silica powder H | 1.4 | 0.95 | 1.5 | 20 | 100 |
| Comp. Ex. 9 | Amorphous silica powder I | 3.0 | 0.957 | 1.5 | 5 | 220 |

TABLE 3-continued

| | | | | | | |
|---|---|---|---|---|---|---|
| Comp. Ex. 10 | Amorphous silica powder J | 2.5 | 0.95 | 1.5 | 18 | 150 |
| Comp. Ex. 11 | Amorphous silica powder F | 6.0 | 5.0 | 7.7 | 10 | 240 |

| | Pore volume of ink receiving layer | | |
|---|---|---|---|
| | 10 nm or more and 30 nm or less (ml/g) | 30 nm or more and 70 nm or less (ml/g) | Pore volume ratio |
| Ex. 1 | 0.45 | 0.35 | 1:0.8 |
| Ex. 2 | 0.43 | 0.21 | 1:0.5 |
| Ex. 3 | 0.61 | 0.37 | 1:0.6 |
| Ex. 4 | 0.27 | 0.11 | 1:0.4 |
| Ex. 5 | 0.46 | 0.31 | 1:0.7 |
| Ex. 6 | 0.41 | 0.15 | 1:0.4 |
| Ex. 7 | 0.3 | 0.12 | 1:0.4 |
| Comp. Ex. 1 | 0.06 | 0.07 | 1:1.2 |
| Comp. Ex. 2 | 0.05 | 0.07 | 1:1.4 |
| Comp. Ex. 3 | 0.26 | 0.23 | 1:0.9 |
| Comp. Ex. 4 | 0.41 | 0.15 | 1:0.4 |
| Comp. Ex. 5 | 0.41 | 0.03 | 1:0.1 |
| Comp. Ex. 6 | 0.31 | 0.15 | 1:0.5 |
| Comp. Ex. 7 | 0.27 | 0.11 | 1:0.4 |
| Comp. Ex. 8 | 0.21 | 0.25 | 1:1.2 |
| Comp. Ex. 9 | 0.27 | 0.06 | 1:0.2 |
| Comp. Ex. 10 | 0.3 | 0.35 | 1:1.2 |
| Comp. Ex. 11 | 0.45 | 0.08 | 1:0.2 |

TABLE 4

| | Image evaluation results | | | | |
|---|---|---|---|---|---|
| Applied ink | Pigment colorability | | Dye colorability | | Surface |
| quantity | 50% | 100% | 50% | 100% | texture |
| Ex. 1 | A | A | A | A | A |
| Ex. 2 | A | B | A | A | A |
| Ex. 3 | A | B | A | A | A |
| Ex. 4 | A | B | A | B | A |
| Ex. 5 | B | A | B | A | A |
| Ex. 6 | B | B | B | B | A |
| Ex. 7 | B | B | B | A | A |
| Comp. Ex. 1 | D | E | D | E | A |
| Comp. Ex. 2 | D | D | D | E | A |
| Comp. Ex. 3 | D | E | D | C | B |
| Comp. Ex. 4 | D | D | D | E | B |
| Comp. Ex. 5 | D | E | D | E | B |
| Comp. Ex. 6 | D | D | D | E | A |
| Comp. Ex. 7 | D | B | D | C | B |
| Comp. Ex. 8 | D | E | D | C | A |
| Comp. Ex. 9 | D | C | D | B | A |
| Comp. Ex. 10 | D | C | D | C | A |
| Comp. Ex. 11 | D | B | D | A | B |

As shown by the results of Examples 1 to 7 in Table 4, the ink jet recording media according to the present invention were all ranked as "A" or "B" as to "colorability in the applied ink quantities of 100% and 50%" in the ink jet recording using the water-based dye ink, and so it is understood that good dye printing performance was achieved. Even in the ink jet recording using the water-based pigment ink, they were all ranked as "A" or "B" as to "colorability in the applied ink quantities of 100% and 50%", and so it is understood that good pigment printing performance was achieved. Further, these recording media were all ranked as "A" as to "surface texture", and so it is understood that a plain-paper-like feel was achieved.

In particular, the ink jet recording media having a high value of 15% by number of particles or more of all the inorganic fine particles in the pore size range of 0.1 μm or more and 1 μm or less like Example 1 were ranked as "A" as to both pigment colorability and dye colorability and also "surface texture".

The ink jet recording media in which the secondary particle size of the inorganic fine particles is 1 μm or more and 3 μm or less and the solid content mass G ($g/m^2$) of the inorganic fine particles in the ink receiving layer satisfies the relationship of $0.3R \leqq G \leqq 1.0R$, like Examples 1 to 3, were all ranked as "A" as to "colorability in the applied ink quantity of 50%", and so it is understood that high coloring was achieved with a small amount of the ink.

However, the ink jet recording media having no ink receiving layer containing inorganic fine particles (Comparative Examples 1 and 2) were poor in the results of "pigment colorability" and "dye colorability".

The ink jet recording medium of Comparative Example 3 provided with the ink receiving layer containing silica having a small particle size was lowered in ink absorbency because the particle size of the silica is too small, and was poor in the results of "pigment colorability" and "surface texture".

The ink jet recording medium of Comparative Example 4 provided with the ink receiving layer containing silica having a large particle size was small in the amount of the silica covering the surface of the substrate because the particle size of the silica is too large and the amount added is also small. Accordingly, the recording medium was poor in the results of "pigment colorability", "dye colorability" and "surface texture".

The ink jet recording medium of Comparative Example 5 provided with the ink receiving layer containing silica having a large particle size and having a small pore volume of 30 nm or more and 70 nm or less was poor in the results of "pigment colorability", "dye colorability" and "surface texture".

The ink jet recording medium of Comparative Example 6 has a small amount of silica covering the surface of the substrate because the content of the silica in the ink receiving layer containing the silica is too small and was poor in the results of "pigment colorability" and "dye colorability".

The ink jet recording medium of Comparative Example 7 was ranked as "B" as to "surface texture" because the content of silica in the ink receiving layer containing the silica is too large. The recording medium was ranked as "B" as to "pigment colorability (applied ink quantity: 100%)", but as "C" as to "dye colorability (applied ink quantity: 100%)". The reason thereof is considered to be attributable to the fact that the dye ink is easy to penetrate into the lower portion of the ink receiving layer and the dye ink fixed to the lower portion of the ink receiving layer is hard to be seen from the above, because the secondary particle size of the silica is 1.6 μm whereas the layer thickness of the ink receiving layer is large.

The ink jet recording medium of Comparative Example 8 provided with the ink receiving layer which had a small pore volume of 10 nm or more and 30 nm or less was ranked as "E" as to "pigment colorability" and "C" as to "dye colorability".

The ink jet recording medium of Comparative Example 9 provided with the ink receiving layer which had a small pore volume of 30 nm or more and 70 nm or less was ranked as "C" as to "pigment colorability (applied ink quantity: 100%)".

The ink jet recording medium of Comparative Example 10 provided with the ink receiving layer of which the pore volume ratio of the pore volume of 10 nm or more and 30 nm or less to the pore volume of 30 nm or more and 70 nm or less did not fall within the range of from 1:0.4 to 1:1 was ranked as "C" as to both "pigment colorability (applied ink quantity: 100%)" and "dye colorability (applied ink quantity: 100%)".

The ink jet recording medium of Comparative Example 11 provided with the ink receiving layer of which the solid content mass G ($g/m^2$) of the inorganic fine particles in the ink receiving layer satisfies the relationship of $0.3R \leqq G \leqq 1.0R$ but of which the secondary particle size of the inorganic fine particles was 6 μm was poor in the results of "surface texture" and "colorability in the applied ink quantity of 50%".

From the results described above, it is understood that it is necessary to provide an ink jet recording medium according to the constitution of the present invention for the purpose of being ranked as "B" or "A" as to all of "pigment colorability", "dye colorability" and "surface texture".

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2007-283613, filed Oct. 31, 2007, and 2008-253341, filed Sep. 30, 2008, which are hereby incorporated by reference herein in their entirety.

What is claimed is:

1. An ink jet recording medium comprising a substrate and an ink receiving layer which is provided on at least one surface of the substrate and contains inorganic fine particles having an average secondary particle size of 1 μm or more and 4 μm or less as measured by a Coulter counter method in an amount of 0.2 $g/m^2$ or more and 2.0 $g/m^2$ or less in terms of solid content mass, wherein the ink receiving layer satisfies the following conditions (1) to (3) with respect to a pore distribution curve as determined by a nitrogen adsorption method, (1) total pore volume in a pore size range of 10 nm or more and 30 nm or less is 0.25 ml/g or more, (2) total pore volume in a pore size range of 30 nm or more and 70 nm or less is 0.1 ml/g or more, and (3) volume ratio of the total pore volume in the pore size range of 10 nm or more and 30 nm or less to the total pore volume in the pore size range of 30 nm or more and 70 nm or less is within a range of from 1:0.4 to 1:1.

2. The ink jet recording medium according to claim 1, wherein inorganic fine particles satisfying the following conditions (4) to (6) with respect to a pore distribution curve of the inorganic fine particles as determined by the nitrogen adsorption method are used as the inorganic fine particles, (4) total pore volume in a pore size range of 10 nm or more and 30 nm or less is 1 ml/g or more, (5) total pore volume in a pore size range of 30 nm or more and 70 nm or less is 0.1 ml/g or more, and (6) volume ratio of the total pore volume in the pore size range of 10 nm or more and 30 nm or less to the total pore volume in the pore size range of 30 nm or more and 70 nm or less is within a range of from 1:0.1 to 1:1.

3. The ink jet recording medium according to claim 1, wherein the inorganic fine particles have an average secondary particle size of 1 μm or more and 3 μm or less, and the solid content mass G ($g/m^2$) of the inorganic fine particles in the ink receiving layer falls within a range of $0.3R \leqq G \leqq 1.0R$ where R is the secondary particle size.

4. The ink jet recording medium according to claim 1, wherein in a particle size distribution curve of the inorganic fine particles as determined by the Coulter counter method, 15% by number of particles or more of all the inorganic fine particles are present in a pore size range of 0.1 μm or more and 1 μm or less.

5. The ink jet recording medium according to claim 1, wherein the inorganic fine particles are of amorphous silica.

6. The ink jet recording medium according to claim 5, wherein the amorphous silica has an oil absorption of 200 $cm^3/100$ g or more.

7. An ink jet recording method comprising applying a water-based ink to the ink jet recording medium according to claim 1 by an ink jet recording system to form an image.

* * * * *